US011305340B1

(12) United States Patent
Goettsch et al.

(10) Patent No.: US 11,305,340 B1
(45) Date of Patent: Apr. 19, 2022

(54) MODULAR MOLD DESIGN FOR CASTING A VEHICLE FRAME AND COMPONENTS

(71) Applicant: GM Global Technology Operations LLC, Detroit, MI (US)

(72) Inventors: David D. Goettsch, Shelby Township, MI (US); Garrold A. DeGrace, Frankenmuth, MI (US); Gregory T. Naismith, Clarkston, MI (US); Madhusudhan Raju Nannapuraju, Farmington Hills, MI (US); Anil K. Sachdev, Rochester Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 17/036,335

(22) Filed: Sep. 29, 2020

(51) Int. Cl.
*B22D 17/22* (2006.01)

(52) U.S. Cl.
CPC ..... *B22D 17/2218* (2013.01); *B22D 17/2236* (2013.01)

(58) Field of Classification Search
CPC ..... B22D 17/2218; B22D 17/2236; B22D 27/00; B22D 27/04; B22D 27/08; B22D 27/09; B22D 27/11; B22D 27/13; B22D 29/00; B22D 33/04; B22C 9/06
See application file for complete search history.

(56) References Cited

U.S. PATENT DOCUMENTS 4,976,305 A * 12/1990 Tanaka ..... B22D 17/2218 164/154.4

* cited by examiner

*Primary Examiner* — Kevin P Kerns
*Assistant Examiner* — Steven S Ha
(74) *Attorney, Agent, or Firm* — Vivacqua Crane, PLLC

(57) ABSTRACT

A modular casting mold for casting an automotive component includes a plurality of die portions defining a mold cavity corresponding to an automotive component, at least one of the plurality of die portions is an active die portion adapted to control the temperature of the modular casting mold throughout the casting process and including features for ejecting an automotive component cast within the modular casting mold, and the modular casting mold adapted to be attached to another modular casting mold for casting a single automotive component.

14 Claims, 3 Drawing Sheets

MODULAR MOLD DESIGN FOR CASTING A VEHICLE FRAME AND COMPONENTS

INTRODUCTION

The present disclosure relates generally to manufacturing an automotive component, and more particularly to a modular casting mold and method thereof for casting large automotive components.

Conventional die casting, also known as high-pressure die casting (HPDC), is a commonly used metal casting process. Die casting typically includes forcing or injecting molten metal under high pressure into a mold cavity. The mold cavity is formed using two or more die portions which have been machined into a shape of the desired casting cavity. Depending on the type of metal material being used, a hot or cold chamber die casting machine may be used, as well as squeeze casting methods, in addition to over-molding, where alloy is casted over/around existing substrates in order to achieve higher structural properties of an end product. One die portion is called a "cover die portion" and the other die portion an "ejector die portion", and where they meet "the parting line". Conventionally, the cover die portion includes an attached shot sleeve cylinder that is gravity filled and in a second metal transport, a plunger injects the molten metal at great velocity into the casting cavity formed by the cover and ejector die. The two-step metal flow process and high velocities needed to reduce temperature loss during injection can cause damage to the metal that weakens the final casting.

When the casting has sufficiently cooled and acquired the strength to be handled, the ejector die is withdrawn from the cover die bringing the casting with it. The ejector die portion typically includes ejector pins and/or a plate to push the casting out of the ejector die. These ejector pins are attached to a movable platen of the casting machine.

High pressure die casting is a cyclic process were the molten metal loses heat to the colder mold as it is injected and solidified. Controlled coolant flow is used to control the temperature distribution across the mold body and the range of the temperature highs and lows. A high mold temperature reduces metal filling temperature loses that may hinder filling out cavity features. A cool mold temperature reduces solidification time of the casting and increases casting production rate of the machine. Thermal management of these two conflicting goals is challenging with the large thermal inertia of a typical automotive HPDC die.

Typically, in the context of automotive component manufacturing and the die casting process, multiple die casting machines are each used to cast different automotive components. For example, a single die casting machine cell in a factory may be dedicated to casting a single automotive component. These components from each casting machine are then assembled or secured together by factory workers or robotic systems to form or partially form a more complicated automotive component, such as the automotive chassis or frame.

Die casting generally involves higher capital costs, long lead times and limited supply base relative to other casting and manufacturing processes. Generally, larger automotive components are made in multiple pieces, and then assembled later. Die molds large enough to make such components in a single piece are expensive, have the complexity of multiple pull components, are difficult to achieve a uniform temperature, too large and heavy to transport efficiently, and are dedicated to a single component, thus multiple large dies molds must be kept on hand, adding tremendous expense. Further, current high pressure die casting molds and processes depend on great injection pressures, and low vacuum levels to achieve required filling and solidification rates.

Thus there is a need for an improved modular die casting mold and associated methods thereof, particularly as related to casting large automotive components, that use low velocity filling, low pressures, active thermal management and low thermal inertia modular thin walled mold construction.

SUMMARY

According to several aspects of the present disclosure, a modular casting mold for casting an automotive component includes a plurality of die portions defining a mold cavity corresponding to an automotive component, at least one of the plurality of die portions being an active die portion adapted to control the temperature of the modular casting mold throughout the casting process and including features for ejecting an automotive component cast within the modular casting mold, and the modular casting mold adapted to be attached to another modular casting mold for casting a single automotive component.

According to another aspect, each active die portion includes burners for heating the active die portion.

According to another aspect, each active die portion includes cooling jets for cooling a casted component within the modular casting mold.

According to another aspect, each active die portion includes air jets for injecting air between an inner surface of the active die portion and a casted automotive component within the modular casting mold to free the casted automotive component from the modular casting mold.

According to another aspect, each active die portion includes jets for injecting pressurized fluid between an inner surface of the active die portion and a casted automotive component within the modular casting mold to free the casted automotive component from the modular casting mold.

According to another aspect, each active die portion is adapted to selectively vibrate to free the casted automotive component from the modular casting mold.

According to another aspect, each active die portion includes mechanical features adapted to push the casted automotive component from the modular casting mold.

According to several aspects of the present disclosure, a modular casting mold assembly for casting an automotive component includes a plurality of modular casting molds adapted to be modularly connected to one another, each of the plurality of modular casting molds including a plurality of die portions defining a mold cavity corresponding to a portion of the automotive component, the mold cavities of the plurality of modular casting molds being in fluid communication with one another when the plurality of modular casting molds are connected to define a mold cavity corresponding to the automotive component, and at least one of the plurality of each of the plurality of modular casting molds being an active die portion adapted to individually control the temperature of each of the plurality of modular casting molds throughout a casting process and including features for ejecting the automotive component cast within the modular casting mold.

According to another aspect, each active die portion includes burners for heating the active die portion and the plurality of modular casting molds.

According to another aspect, each active die portion includes cooling jets for cooling a casted automotive component within the modular casting mold assembly.

According to another aspect, each active die portion includes air jets for injecting pressurized air between an inner surface of the active die portion and the casted automotive component within the modular casting mold assembly to free the casted automotive component from the modular casting mold assembly.

According to another aspect, each of the active die portions includes jets for injecting pressurized fluid between an inner surface of the active die portion and the casted automotive component within the modular casting mold assembly to free the casted automotive component from the modular casting mold assembly.

According to another aspect, each of the plurality of active die portions is adapted to selectively vibrate to free the casted automotive component from the modular casting mold assembly.

According to another aspect, each of the active die portions includes mechanical features adapted to push the casted automotive component from the at least one ejector die portion of the modular casting mold.

According to several aspects of the present disclosure, a method of forming an automotive component includes assembling a plurality of modular casting molds, each of the plurality of modular casting molds including a plurality of die portions defining a mold cavity corresponding to a portion of the automotive component, the mold cavities of the plurality of modular casting molds being in fluid communication with one another when the plurality of modular casting molds are connected to define a mold cavity corresponding to the automotive component, pre-heating the modular casting mold assembly by actuating burners included within at least one active die portion of each of the plurality of modular casting molds, filling the mold cavity with molten material, de-activating the burners included within the active die portions, cooling the modular casting mold assembly and the molten material within the mold cavity by actuating cooling jets included within the active die portions of each of the plurality of modular casting molds to solidify the molten material within the mold cavity, de-activating the cooling jets included within the active die portions, opening the modular casting mold assembly, and ejecting the casted automotive component from the plurality of modular casting molds.

According to another aspect, ejecting the casted automotive component from the plurality of modular casting molds includes actuating air jets included within the active die portions and injecting pressurized air between the active die portions and the casted automotive component.

According to another aspect, ejecting the casted automotive component from the plurality of modular casting molds includes actuating jets included within the active die portions and injecting pressurized fluid between the active die portions and the casted automotive component.

According to another aspect, ejecting the casted automotive component from the plurality of modular casting molds includes vibrating each of the active die portions.

According to another aspect, ejecting the casted automotive component from the plurality of modular casting molds includes actuating mechanical features within each of the active die portions.

According to another aspect, opening the modular casting mold assembly and ejecting the casted automotive component from the plurality of modular casting molds includes one of opening each of the plurality of modular casting molds and ejecting the casted automotive component from each of the plurality of modular casting molds simultaneously, and sequentially opening each of the plurality of modular casting molds and ejecting the casted automotive component from each of the plurality of modular casting molds, one at a time.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
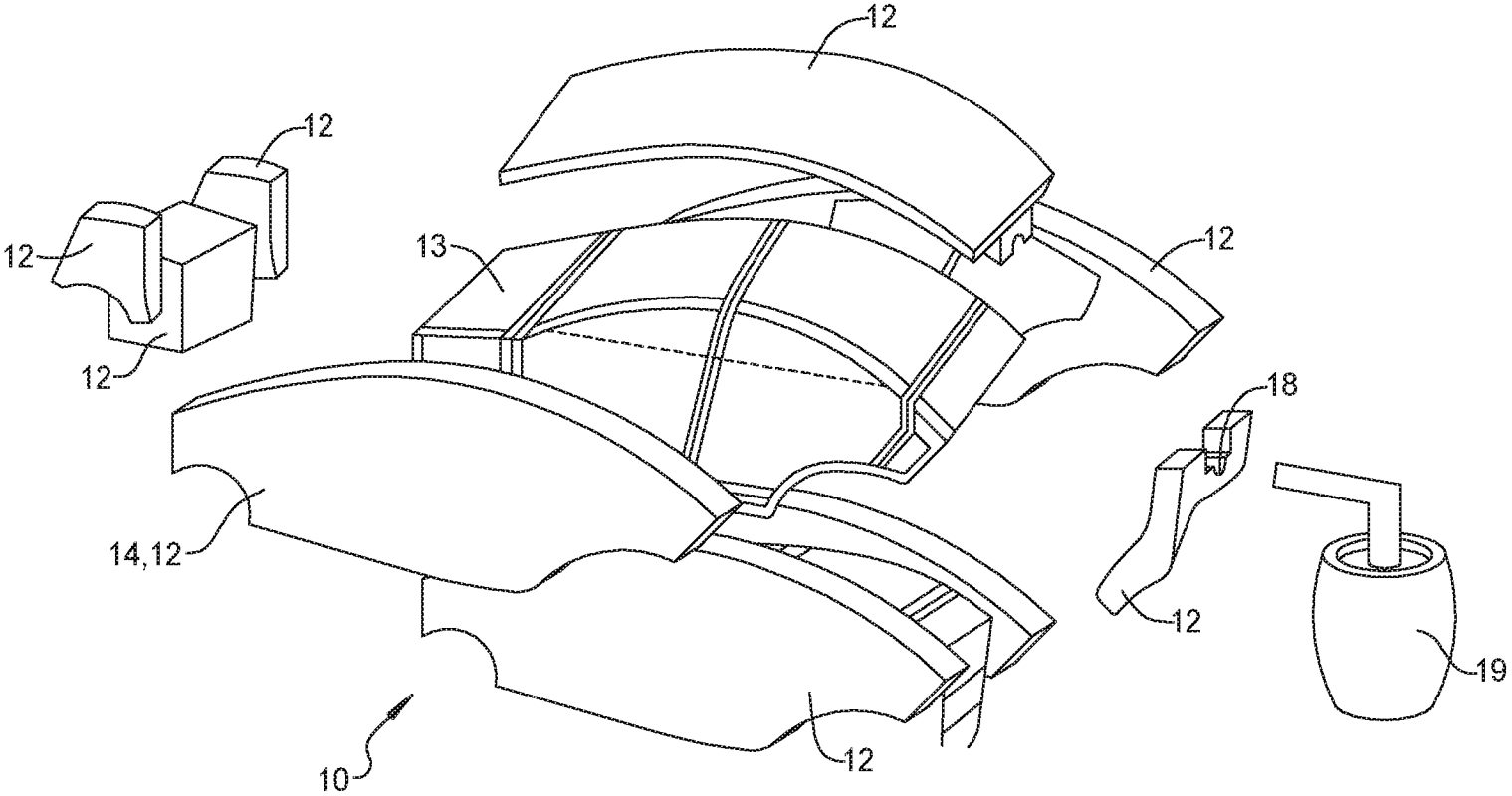
FIG. 1 is a perspective exploded view of a modular casting mold according to an exemplary embodiment of the present disclosure.

Referring to FIG. 1, a modular casting mold 10 for casting an automotive component includes a plurality of die portions 12. The plurality of die portions 12 define a mold cavity 16, shown in FIG. 4, corresponding to an automotive component 13. As shown in FIG. 1, in an exemplary embodiment, an exploded view of the modular casting mold 10 includes ten die portions 12. One of the die portions 12 includes an inlet 18 configured to allow molten material to flow into the mold cavity 16 from a source of molten material 19.

Figure 2:
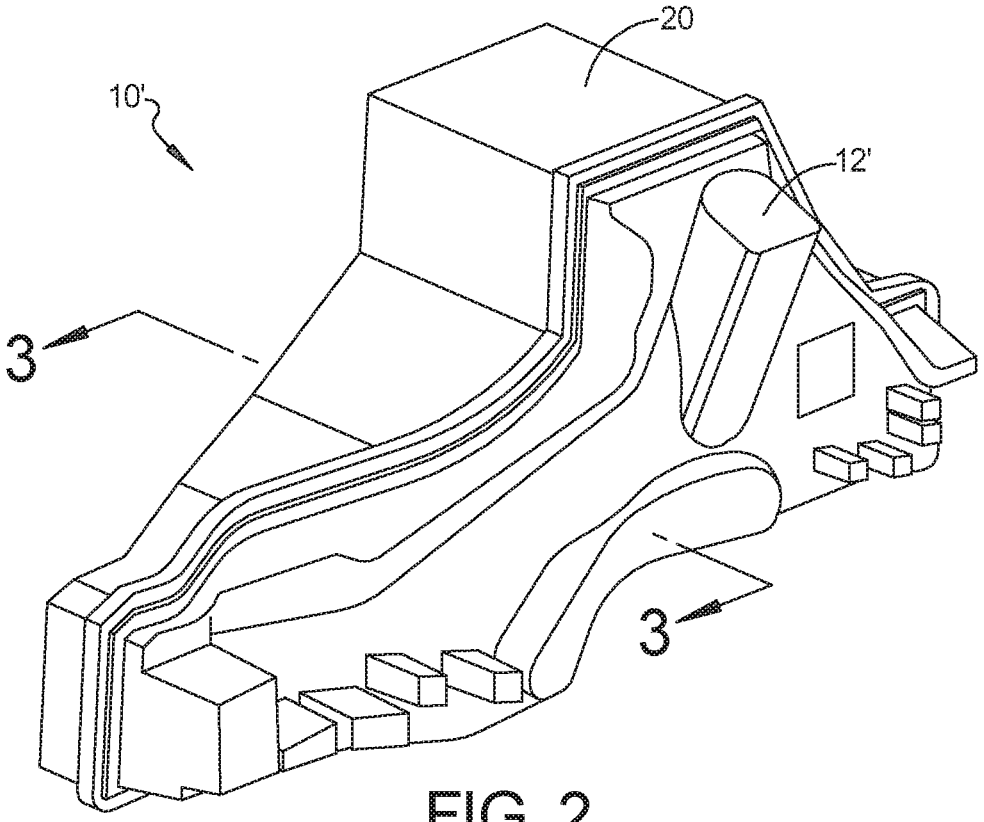
FIG. 2 is a perspective view of a modular casting mold according to another exemplary embodiment of the present disclosure.
Figure 4:
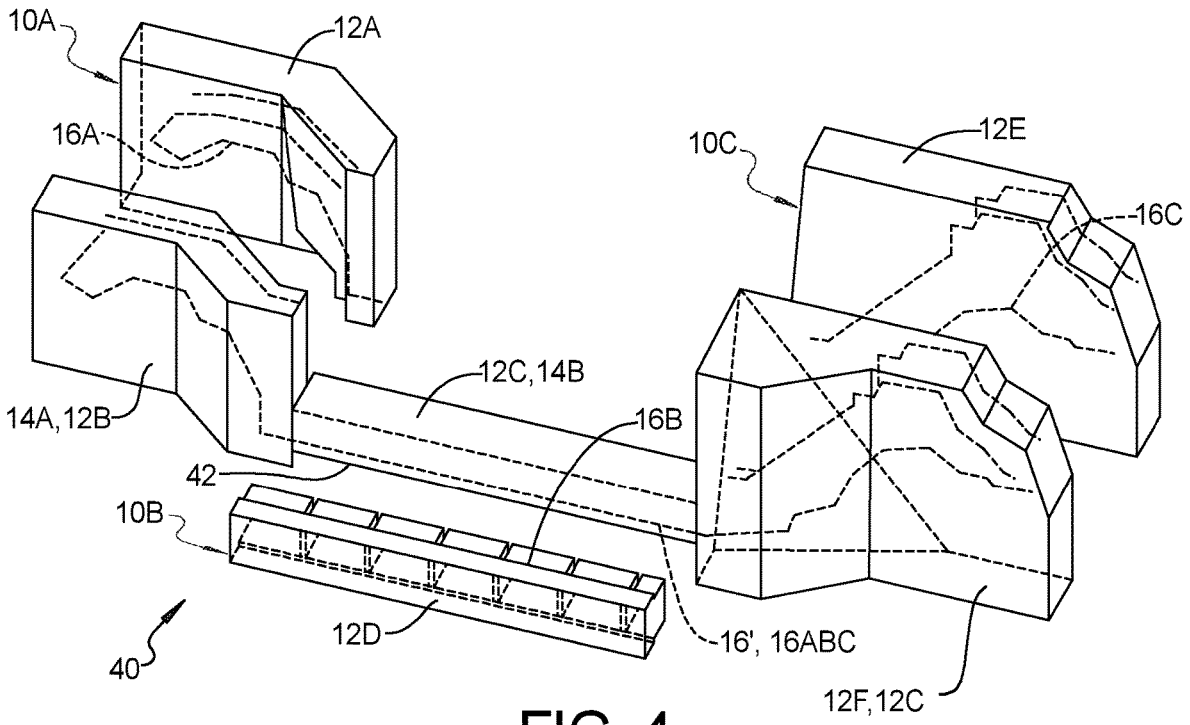
FIG. 4 is an exploded perspective view of a modular casting mold assembly according to an exemplary embodiment of the present disclosure.

Referring to FIG. 2 and FIG. 4, in another exemplary embodiment, the modular casting mold 10' includes two die portions 12' that define a mold cavity 16'. Referring to FIG. 1 and FIG. 4, at least one of the die portions 12' is an active die portion 14, 14'. The active die portion 14, 14' is adapted to control the temperature of the modular casting mold 10, 10' throughout the casting process. Active thermal management of the modular casting mold 10, 10' allows the molten material injected into the mold to completely fill the mold cavity 16 under low pressure, and high cooling rates reduces the solidification time. The active die portion 14 further includes features for ejecting an automotive component 13 cast within the modular casting mold 10, 10'.

The ability to fill the mold cavity 16 with molten material under low pressure allows the modular casting mold 10, 10' to be adapted to be attached to another modular casting mold 10, 10' for casting a single automotive component 13. It is to be understood that a modular casting mold 10, 10' of the present disclosure includes at least one active die portion 14, 14'. More than one active die portion 14, 14' may be present, or, all of the die portions 12, 12' can be active die portions 14, 14'. The modular casting mold 10, 10', as shown in FIG.

Figure 3:
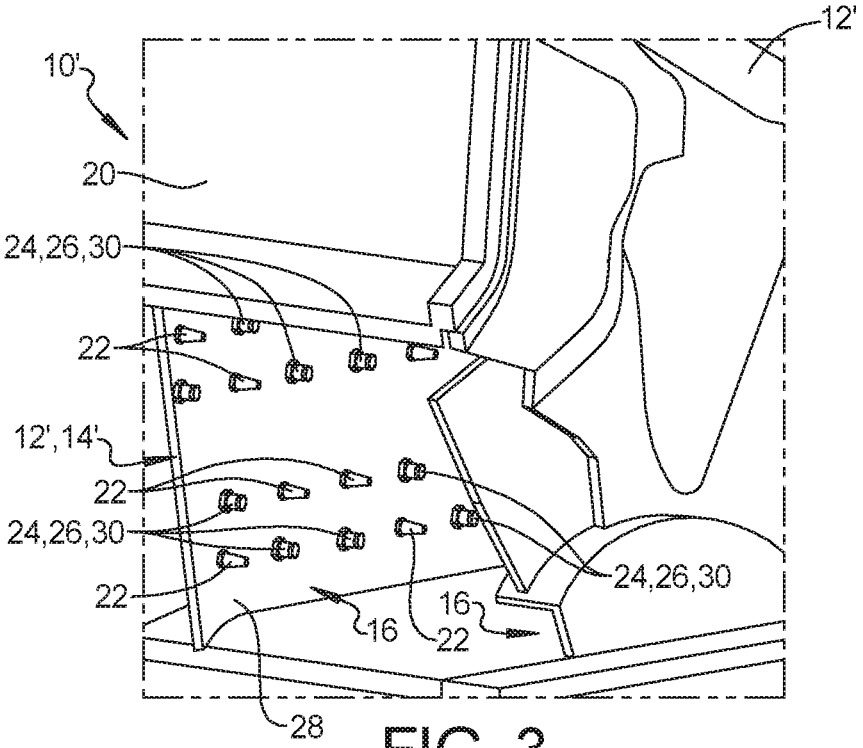
FIG. 3 is a sectional view of FIG. 2, taken along line 3-3.

2 and FIG. 3, includes a frame 20 that supports the active die portion 14, 14' and accompanying elements thereon.

In an exemplary embodiment, each active die portion 14, 14' includes burners 22 for heating the active die portion 13. The burners 22 may use direct flame, or radiant heat to heat up the active die portion 14, 14', and the die portions 12, and to actively control the temperature of the modular casting mold 10, 10' during filling of the mold cavity 16.

In another exemplary embodiment, each active die portion 14, 14' includes cooling jets 24 for cooling a casted component within the modular casting mold 10, 10'. The cooling jets 24 are adapted to cool the molten material within the mold cavity 16 to solidify the automotive component being cast therein. The cooling jets 24 are controllable to allow active control of the cooling of the molten material to accommodate casting solidification contraction and mold to mold interferences when the modular casting mold 10, 10' is attached to another modular casting mold 10, 10'.

In another exemplary embodiment, each active die portion 14, 14' includes air jets 26 for injecting air between an inner surface 28 of the active die portion 14, 14' and a casted automotive component within the modular casting mold 10, 10'. The air jets 26 are adapted to pressurize the air in the frame 20. Vent plugs placed in the active die portion 14' allow the pressured air to act on the solidified cast automotive component 13 and free the casted automotive component 13 from the modular casting mold 10, 10'.

In another exemplary embodiment, each active die portion 14, 14' includes jets 30 for injecting pressurized fluid between the inner surface 28 of the active die portion 13 and the casted automotive component within the modular casting mold 10, 10'. The pressurized fluid may be water or lubricant, or a combination of the two, and may be directed to targeted, high contact pressure surfaces between the casted automotive component and the mold cavity 16 to free the casted automotive component from the modular casting mold 10, 10'.

In another exemplary embodiment, each active die portion 14, 14' is adapted to selectively vibrate to free the casted automotive component from the modular casting mold 10.

In another exemplary embodiment, each active die portion 14, 14' includes mechanical features adapted to push the casted automotive component from the modular casting mold 10. The mechanical features may be ejector pins, or a moveable plate adapted to selectively push the casted automotive component.

Referring to FIG. 4, the modular casting mold 10 is adapted to be attached to other modular casting molds 10 to create a single casted automotive component. A modular casting mold assembly 40 for casting an automotive component 42 includes a plurality of modular casting molds 10A, 10B, 10C adapted to be modularly connected to one another. In the exemplary embodiment shown in FIG. 4, the modular casting mold assembly 40 includes a first modular casting mold 10A, a second modular casting mold 10B and a third modular casting mold 100.

Each of the first, second and third modular casting molds 10A, 10B, 10C includes a plurality of die portions 12A, 12B, 12C, 12D, 12E, 12F defining first, second and third modular mold cavities 16A, 16B, 16C respectively. Each of the first, second and third modular mold cavities 16A, 16B, 16C corresponds to a portion of the automotive component 42. The first, second and third modular mold cavities 16A, 16B, 16C of the first, second and third modular casting molds 10A, 10B, 10C are in fluid communication with one another when the first, second and third modular casting molds 10A, 10B, 10C are connected to define a single mold cavity 16', 16ABC corresponding to the automotive component 42. Each of the first, second and third modular casting molds 10A, 10B, 10C of the modular casting mold assembly 40 includes features substantially identical to the modular casting mold 10' shown in FIG. 3.

At least one of the die portions 12A, 12B, 12C, 12D, 12E, 12F of each of the first, second and third modular casting molds 10A, 10B, 10C is an active die portion 14A, 14B, 14C that is adapted to individually control the temperature of each of the first, second and third modular casting molds 10A, 10B, 100 throughout a casting process and includes features for ejecting the automotive component 42 cast within the modular casting mold assembly 40.

Referring again to FIG. 4 for reference, in an exemplary embodiment, each of the active die portions 14A, 14B, 14C include burners 22 for heating the die portions 12A, 12B, 12C, 12D, 12E, 12F and the active die portions 14A, 14B, 14C of each of the first, second and third modular casting molds 10A, 10B, 10C. The burners 22 may use direct flame, or radiant heat to heat up the active die portions 14A, 14B, 14C and the die portions 12A, 12B, 12C, 12D, 12E, 12F and to actively control the temperature of the active die portions 14A, 14B, 14C and the die portions 12A, 12B, 12C, 12D, 12E, 12F during the filling of the mold cavity 16ABC.

In another exemplary embodiment, each active die portion 14A, 14B, 14C includes cooling jets 24 for cooling the casted automotive component 42 within the modular casting mold assembly 40. The cooling jets 24 are adapted to cool the molten material within the mold cavity 16ABC to solidify the automotive component 42 being cast therein. The cooling jets 24 are controllable to allow active control of the cooling of the molten material to accommodate casting solidification contraction and mold to mold interferences between the first, second and third modular casting molds 10A, 10B, 100.

In another exemplary embodiment, each active die portion 14A, 14B, 14C includes air jets 26 for injecting air between the inner surface 28 of the active die portion 14A, 14B, 14C and the casted automotive component 42 within the modular casting mold assembly 40. The air jets 26 are adapted to pressurize the air injected between the inner surfaces 28 of the active die portion 14A, 14B, 14C and the casted automotive component 42 within the modular casting mold assembly 40 to free the casted automotive component 42 from the first, second and third modular casting molds 10A, 10B, 100.

In another exemplary embodiment, each active die portion 14A, 14B, 14C includes jets 30 for injecting pressurized fluid between the inner surfaces 28 of the active die portion 14A, 14B, 14C and the casted automotive component 42 within the modular casting mold assembly 40. The pressurized fluid may be water or lubricant, or a combination of the two, and may be directed to targeted, high contact pressure surfaces between the casted automotive component 42 and the mold cavity 16ABC to free the casted automotive component 42 from the modular casting mold assembly 40.

In another exemplary embodiment, each active die portion 14A, 14B, 14C is adapted to selectively vibrate to free the casted automotive component 42 from the modular casting mold assembly 40.

Figure 5:
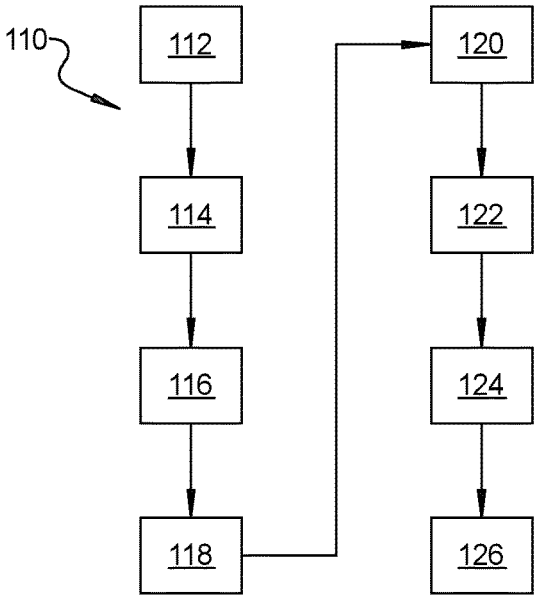
FIG. 5 is a flow chart illustrating a method incorporating the modular casting mold and modular casting mold assembly of the present disclosure.

In another exemplary embodiment, each active die portion 14A, 14B, 14C includes mechanical features adapted to push the casted automotive component 42 from the modular casting mold assembly 40. The mechanical features may be ejector pins, or a moveable plate adapted to selectively push the casted automotive component Referring to FIG. 5, a method 110 of forming an automotive component incorporating the modular casting mold 10 and modular casting mold assembly 40 of the present disclosure includes, moving to block 112, assembling a plurality of modular casting molds 10A, 10B, 100 each of the plurality of modular casting molds 10A, 10B, 100 including a plurality of die portions 12A, 12B, 12C, 12D, 12E, 12F defining a mold cavity 16A, 16B, 16C corresponding to a portion of the automotive component 42, the mold cavities 16A, 16B, 16C of the plurality of modular casting molds 10A, 10B, 100 being in fluid communication with one another when the plurality of modular casting molds 10A, 10B, 100 are connected to define a mold cavity 16ABC corresponding to the automotive component 42.

Moving on to block 114, after the modular casting mold assembly 40 is assembled, the method includes heating the modular casting mold assembly 40 by actuating burners 22 included within active die portions 14A, 14B, 14C of each of the plurality of modular casting molds 10A, 10B, 10C.

Moving on to block 116, the mold cavity 16ABC is filled with molten material. The material may be any suitable material depending on the automotive component 42 that is being cast. In an exemplary embodiment, the mold cavity is filled with molten aluminum or magnesium. In a variation of this embodiment, the entire modular casting mold assembly 40 may be placed within a furnace to provide added ability to heat and control the temperature of the modular casting mold assembly 40 before and during filling of the mold cavity 16ABC.

Moving on to block 118, once the mold cavity is filled, the burners 22 within the active die portions 14A, 14B, 14C are de-activated. Moving on to block 120, the modular casting mold assembly 40 and the molten material within the mold cavity 16ABC is cooled by actuating cooling jets 24 included within active die portions 14A, 14B, 14C of each of the plurality of modular casting molds 10A, 10B, 10C. Cooling the modular casting molds 10A, 10B, 100 and the molten material helps to solidify the molten material within the mold cavity 16ABC. By actively controlling the temperature of the modular casting molds 10A, 10B, 100, both when heating and cooling, casting solidification contraction and mold to mold interferences between the modular casting molds 10A, 10B, 100 is accounted for.

Moving to block 122, the cooling jets 22 are deactivated. Moving to block 124, the modular casting mold assembly 40 is opened, and at block 126, the casted automotive component 42 is ejected from the modular casting molds 10A, 10B, 100.

In an exemplary embodiment, ejecting the casted automotive component 42 from the modular casting molds 10A, 10B, 100, shown at block 126, includes actuating air jets 26 included within the active die portions 14A, 14B, 14C and injecting pressurized air between the active die portions 14A, 14B, 14C and the casted automotive component 42.

In another exemplary embodiment, ejecting the casted automotive component 42 from the modular casting molds 10A, 10B, 100, shown at block 126, includes actuating jets 30 included within the active die portions 14A, 14B, 14C and injecting pressurized fluid between the active die portions 14A, 14B, 14C and the casted automotive component 42.

In another exemplary embodiment, ejecting the casted automotive component 42 from the modular casting molds 10A, 10B, 100, shown at block 126, includes vibrating each of the active die portions 14A, 14B, 14C.

In still another exemplary embodiment, ejecting the casted automotive component 42 from the modular casting molds 10A, 10B, 100, shown at block 126, includes actuating mechanical features within each active die portion 14A, 14B, 14C.

In one exemplary embodiment, opening the modular casting mold assembly 40 and ejecting the casted automotive component 42 from the modular casting molds 10A, 10B, 100, shown at blocks 124 and 126, includes opening each of the plurality of modular casting molds 10A, 10B, 100 and ejecting the casted automotive component 42 from the modular casting molds 10A, 10B, 10C simultaneously. Alternatively, opening the modular casting mold assembly 40 and ejecting the casted automotive component 42 from the modular casting molds 10A, 10B, 100, shown at blocks 124 and 126, includes sequentially opening each of the plurality of modular casting molds 10A, 10B, 100 and ejecting the casted automotive component 42 from the modular casting molds 10A, 10B, 100, one at a time.

The modular casting mold assembly 40 and associated method 110 of the present disclosure offers the advantage of producing relatively large cast automotive components at reduced cycle times and reduces overall mass and cost. Actively managing the temperature of the modular casting mold assembly 40 allows the molten material injected therein to remain liquified long enough to flow throughout the mold cavity 16ABC. This in turn, allows the molten material used for the cast component to be injected at low pressure, rather than being injected at high pressures and velocities. Because the molten material is injected at low pressures it is possible to use a modular design that allows smaller individual molds 10 to be assembled modularly to create larger parts. In high pressure applications, the structure needed to keep modular parts assembled correctly during casting would be prohibitive. At low pressures, modular molds can be fastened together with lower risk of distortion or molds becoming detached, as with high pressure methods. Using modular molds allows different molds to be used for different components, saving overall tooling costs and storage. Finally, the end result is a single casted component that is stronger, cheaper and weighs less than a similar component, made piecemeal and attached together. Bolting or welding individual components together adds mass to the final product, and junctures between attached components may result in stress concentrations or weakness resulting in potential failure.

A thin walled modular casting mold design enables the construction of complex cavity geometries while still allowing for the mold piece removal from the casting surface including, most notably, the interior casting surfaces. Low pressure or gravity pour filling of casting cavity is used in conjunction with back wall applied mold heating for fluidity length and containment requirements of cavity. Back wall applied coolant time and intensity profile can be specified for casting porosity, material property and cycle time requirements. Casting release from individual mold pieces is aided by applied gas pressure, lubricant and mold vibration.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A modular casting mold for casting an automotive component, comprising:

a plurality of die portions defining a mold cavity corresponding to the automotive component;

the plurality of die portions including at least one active die portion adapted to control the temperature of the modular casting mold throughout the casting process and including features for ejecting the automotive component cast within the modular casting mold; and the modular casting mold adapted to be attached to another modular casting mold for casting the automotive component.

2. The modular casting mold of claim 1, wherein the at least one active die portion includes burners for heating the active die portion.

3. The modular casting mold of claim 1, wherein the at least one active die portion includes cooling jets for cooling a casted component within the modular casting mold.

4. The modular casting mold of claim 1, wherein the at least one active die portion includes air jets for injecting air between an inner surface of the active die portion and a casted automotive component within the modular casting mold to free the casted automotive component from the modular casting mold.

5. The modular casting mold of claim 1, wherein the at least one active die portion includes jets for injecting pressurized fluid between an inner surface of the active die portion and a casted automotive component within the modular casting mold to free the casted automotive component from the modular casting mold.

6. The modular casting mold of claim 1, wherein the at least one active die portion is adapted to selectively vibrate to free a casted automotive component within the modular casting mold from the modular casting mold.

7. The modular casting mold of claim 1, wherein the at least one active die portion includes mechanical features adapted to push a casted automotive component from the modular casting mold.

8. A modular casting mold assembly for casting an automotive component, comprising:

a plurality of modular casting molds adapted to be modularly connected to one another, each of the plurality of modular casting molds including:

a plurality of die portions defining a modular mold cavity corresponding to a portion of the automotive component, modular mold cavities of the plurality of modular casting molds being in fluid communication with one another when the plurality of modular casting molds are connected to define a mold cavity corresponding to the automotive component; and the plurality of die portions of each of the plurality of modular casting molds including at least one active die portion adapted to individually control the temperature of each of the plurality of modular casting molds throughout a casting process and including features for ejecting the automotive component cast within the modular casting mold.

9. The modular casting mold assembly of claim 8, wherein the at least one active die portion includes burners for heating the active die portion and the modular casting mold assembly.

10. The modular casting mold assembly of claim 8, wherein the at least one active die portion includes cooling jets for cooling a casted automotive component within the modular casting mold assembly.

11. The modular casting mold assembly of claim 8, wherein the at least one active die portion includes air jets for injecting pressurized air between an inner surface of the at least one active die portion and a casted automotive component within the modular casting mold assembly to free the casted automotive component from the modular casting mold assembly.

12. The modular casting mold assembly of claim 8, wherein the at least one active die portion includes jets for injecting pressurized fluid between an inner surface of the active die portion and a casted automotive component within the modular casting mold assembly to free the casted automotive component from the modular casting mold assembly.

13. The modular casting mold assembly of claim 8, wherein the at least one active die portion is adapted to selectively vibrate to free a casted automotive component from the modular casting mold assembly.

14. The modular casting mold assembly of claim 8, wherein the at least one active die portion includes mechanical features adapted to push a casted automotive component from the modular casting mold assembly.

* * * * *